US008915046B2

(12) United States Patent
Wright, III et al.

(10) Patent No.: US 8,915,046 B2
(45) Date of Patent: Dec. 23, 2014

(54) REINFORCEMENT FOR REINFORCED CONCRETE AND METHODS FOR MANUFACTURING THEREOF

(71) Applicants: Chester Wright, III, Las Vegas, NV (US); Nicolai Boguslavschi, Chisinau (MD); Arkady Zalan, Henderson, NV (US)

(72) Inventors: Chester Wright, III, Las Vegas, NV (US); Nicolai Boguslavschi, Chisinau (MD); Arkady Zalan, Henderson, NV (US)

( * ) Notice: Subject to any disclaimer, the term of this patent is extended or adjusted under 35 U.S.C. 154(b) by 0 days.

(21) Appl. No.: 13/949,572

(22) Filed: Jul. 24, 2013

(65) Prior Publication Data

US 2014/0059975 A1 Mar. 6, 2014

Related U.S. Application Data

(60) Provisional application No. 61/697,574, filed on Sep. 6, 2012.

(51) Int. Cl.

| | |
|---|---|
| ***E04C 3/00*** | (2006.01) |
| ***E04C 5/00*** | (2006.01) |
| ***B21D 11/15*** | (2006.01) |
| ***B29D 99/00*** | (2010.01) |

(52) U.S. Cl.

CPC . *E04C 5/00* (2013.01); *B21D 11/15* (2013.01); *B29D 99/0003* (2013.01)

USPC ..... 52/857; 52/851; 52/852; 52/853; 52/856

(58) Field of Classification Search

CPC .... E04C 5/00–5/012; E04C 5/02; E04C 5/03; E04C 5/07; E04C 5/073; E04C 5/085

USPC ..... 52/831, 836, 850, 851, 852, 853, 855, 52/856, 857, FOR. 164–FOR. 172

See application file for complete search history.

(56) References Cited

U.S. PATENT DOCUMENTS 615,304 A * 12/1898 Propst ..... 256/57
881,618 A * 3/1908 Ramsey ..... 52/857

(Continued)

FOREIGN PATENT DOCUMENTS

| | | | |
|---|---|---|---|
| BY | 361 | U | 9/2001 |
| GB | 2197006 | A | 5/1988 |
| RU | 2467075 | C2 | 11/2012 |
| SU | 1724834 | A1 | 4/1992 |

OTHER PUBLICATIONS

Popova, N., International Search report Application No. PCT/US 2013/052013, Nov. 14, 2013.

*Primary Examiner* — Ryan Kwiecinski

(74) *Attorney, Agent, or Firm* — Arent Fox LLP; Michael Fainberg

(57) ABSTRACT

Disclosed a reinforcement structure for reinforced concrete and methods for manufacturing thereof. In one aspect, the reinforcement structure includes a rod comprising a spiral strip having a pitch between 1.0 and 10.0 times a width of the strip and a ratio of thickness of the strip to the width of the strip in a range of 1:4 to 1:10. The surface of the spiral strip may be entirely or partially corrugated with ribs of arbitrary shape and having height in a range of 0.05% to 0.30% of the thickness of the strip. In another aspect, method for manufacturing a reinforcement structure comprises flattening a wire rod into a flat strip, corrugating it with ribs, and twisting the ribbed strip into a spiral of the specified pitch.

5 Claims, 3 Drawing Sheets

(56) References Cited

U.S. PATENT DOCUMENTS

| | | | | | |
|---|---|---|---|---|---|
| 1,111,646 | A | * | 9/1914 | Compton | 52/600 |
| 1,123,518 | A | | 1/1915 | Gillespie | |
| 1,551,863 | A | * | 9/1925 | Berry | 52/105 |
| 1,980,668 | A | * | 11/1934 | Davis | 52/852 |
| 2,260,779 | A | * | 10/1941 | Hoffmann | 72/187 |
| 3,214,877 | A | * | 11/1965 | Akin | 428/574 |
| 3,376,686 | A | * | 4/1968 | Salm | 52/687 |
| 3,378,985 | A | * | 4/1968 | Bugan | 52/852 |
| 3,936,278 | A | * | 2/1976 | Moens | 428/592 |
| 5,725,954 | A | * | 3/1998 | Montsinger | 428/397 |
| 5,950,393 | A | * | 9/1999 | Stecker | 52/836 |
| 6,612,085 | B2 | * | 9/2003 | Edwards et al. | 52/649.1 |
| 6,706,380 | B2 | | 3/2004 | Edwards et al. | |
| 7,045,210 | B2 | * | 5/2006 | Bleibler | 428/367 |

* cited by examiner

REINFORCEMENT FOR REINFORCED CONCRETE AND METHODS FOR MANUFACTURING THEREOF

CROSS-REFERENCE TO RELATED APPLICATION

This application claims benefit of priority under 35 U.S.C. 119(e) to Provisional Application No. 61/697,574 filed Sep. 6, 2012 and incorporated by reference herein.

TECHNICAL FIELD

The present disclosure relates generally to field of construction materials and, particularly, to reinforcement for precast and monolithic reinforced concrete structures.

BACKGROUND

Reinforced concrete is a popular construction material. It typically uses embedded reinforcement structures that have high tensile strength and ductility to reinforce concrete.

One popular type of reinforcement is a steel reinforcement bar (i.e. rebar). A rebar may be a hot-rolled or cold-drawn metal rod with circular cross section and ribbed surface. The ribs enhance bonding between the rebar and concrete. However, due to small height of the ribs, the bonding between the ribs and concrete can break under the stress, causing slipping of the rebar inside concrete, which weakens the concrete. To obtain the necessary tensile strength of the reinforcement, the number of rebars must be increased, which adversely increases weight of the reinforcement and cost of construction of the reinforced concrete.

Another popular type of reinforcement may be manufactured from tubular blanks with hot-rolled corrugated ribs. This manufacturing method provides a reduced weight of the reinforcement. However, such a tubular reinforcement structure typically cannot be made with a diameter less than 20 mm. Furthermore, the economic gain is insignificant, due to the increased complexity and energy intensity in the manufacturing of such a reinforcement.

Another type of reinforcement is a cable reinforcement, which includes several metal wires wound into strands. This type of reinforcement structure provides a more effective reinforcement than the rebars, but has much higher cost of manufacture.

Thus, there is a need for improved reinforcement for reinforced concrete, which has lower weight and lower cost of manufacture then the known types of reinforcements.

SUMMARY

Disclosed herein a reinforcement structure for reinforced concrete and methods of manufacturing thereon. In one example aspect of the invention, a reinforcement structure includes a rod comprising a spiral strip having a pitch between 1.0 and 10.0 times the width of the strip and a ratio of thickness of the strip to the width of the strip in a range of 1:4 to 1:10.

In another example aspect, the edges of the spiral strip may be rounded.

In another example aspect, the surface of the spiral strip may be entirely or partially corrugated with ribs of arbitrary shape, such as straight, reticular, or pointed ribs.

In various example aspects, the height of the ribs may be in a range of 0.05% to 0.30% of the thickness of the strip.

In another example aspect, the spiral may have a regular or an irregular pitch.

In another example aspect, the spiral may comprise a monofilar or multifilar helix.

In yet another example aspect of the invention, a method for manufacturing a monofilar reinforcement structure comprises flattening a wire rod into a flat strip, corrugating the flat strip with ribs, and twisting the ribbed strip into a spiral of having a specified pitch.

In yet another example aspect of the invention, a method for manufacturing a multifilar reinforcement for reinforced concrete comprises extruding a star-shaped contour having a plurality of rays, each ray including a flat strip, wherein a ratio of thickness of a strip to a width of the strip in a range of 1:4 to 1:10; twisting the plurality of strips a into multifilar spiral having a pitch between 1.0 and 10.0 times the width of the strip; and concurrently with twisting, corrugating on each of the strips a plurality of ribs having height in a range of 0.05% to 0.30% of the thickness of the strip.

The above simplified summary of example aspects of the invention serves to provide a basic understanding of the invention. This summary is not an extensive overview of all contemplated aspects, and is intended to neither identify key or critical elements of all aspects nor delineate the scope of any or all aspects of the invention. Its sole purpose, is to present one or more aspects in a simplified form as a prelude to the more detailed description of the invention that follows. To the accomplishment of the foregoing, the one or more aspects of the present invention comprise the features described and particularly pointed out in the claims.

BRIEF DESCRIPTION OF THE DRAWINGS

The accompanying drawings, which are incorporated into and constitute a part of this specification, illustrate one or more example aspects of the invention and, together with the detailed description, serve to explain their principles and implementations.

DETAILED DESCRIPTION

Disclosed herein are example aspects of a reinforcement structure for reinforced concrete and methods for manufacturing thereof. Those of ordinary skill in the art will realize that the following description is illustrative only and is not intended to be in any way limiting. Other aspects will readily suggest themselves to those skilled in the art having the benefit of this disclosure. Reference will now be made in detail to implementations of the example aspects as illustrated in the accompanying drawings. The same reference indicators will be used throughout the drawings and the following description to refer to the same or like items.

Figure 1:
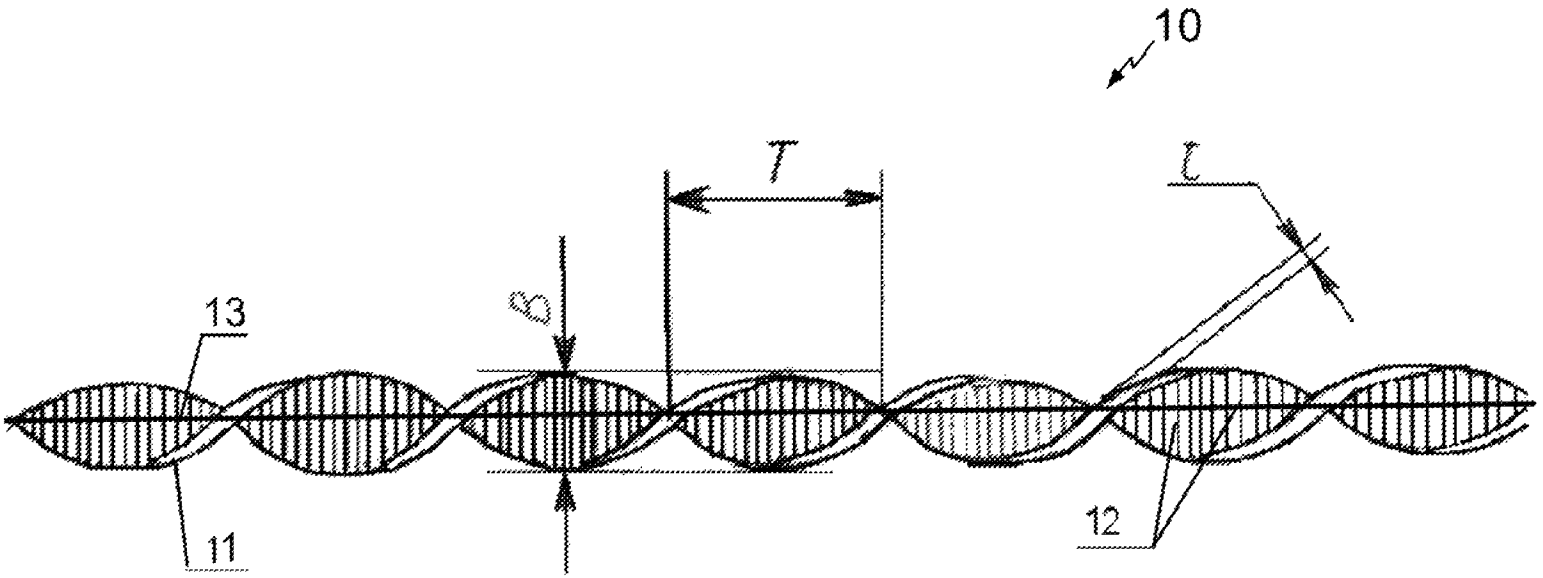
FIG. 1 illustrates a general view of a reinforcement structure for reinforced concrete in accordance with aspects of the present invention.

FIG. 1 illustrates a general view of a reinforcement structure for reinforced concrete in accordance with one aspect of the present invention. As shown, the reinforcement structure includes a rod 10 comprising a spiral strip 11, which is twisted into a monofilar or multifilar helix along a longitudinal axis 13 of the strip 11. The spiral strip 11 has diameter (B) and thickness (t).

In various aspects, the spiral may have regular or irregular pitch (T), which may vary (or be constant) between about 1.0 and 10.0 times of the diameter (B) of a cylinder into which the spiral is inscribed. In another aspect, a ratio of the thickness (t) of the strip 11 to its diameter (B) may be in the range of about 1:4 to 1:10. In various aspects, the spiral strip 11 may comprise a monofilar helix or a multifilar helix, such as a double or triple helix. In various aspects, the rod 10 may be made of steel, metal or plastic, such as composite plastic.

In one aspect, the one or more surfaces of the spiral strip 11 may be completely or partially corrugated with ribs 12 of arbitrary shape. In various aspects, the ribs 12 may be straight, reticular or pointed in shape. In various aspects, the ribs 12 may be transverse (as shown) or longitudinal is direction. In one aspect, the height of the ribs 12 above the surface of the strip 11 may be between 0.05 and 0.30% of the thickness (t) of the spiral strip 11.

One advantage of the spiral reinforcement structure is a reduction in the overall mass of the reinforcement while preserving firmness of the reinforced concrete, which attributed to a fuller utilization of the firmness of both the concrete and reinforcement.

For example, the spiral reinforcement structure has substantially smaller mass than rebar-type reinforcement with equal resistance of the reinforced concrete structure to bending.

Another advantage of the spiral reinforcement structure is that is provides a significant increase in the contact surface between the reinforcement structure and the surrounding concrete material and, consequently, an increase in the load that the reinforced concrete can withstand with help of the reinforcement structure without failing.

An advantage of having ribs on the surface of the spiral reinforcement structure is that they prevent an "unscrewing" of the reinforcement structure from concrete under load.

An advantage of rounding of the edges of the spiral reinforcement structure is that it prevents concentration of stress in concrete at the point of contact with the reinforcement.

It should be also noted that a reinforced concrete that incorporates the described spiral reinforcement structure has the same strength as a reinforced concrete that incorporates a rebar-type reinforcement having equal cross-section diameter. For example, the Moldavian Scientific Research Institute for Construction "INCERCOM" carried out investigations on the reinforced concrete samples with a size of 160×40×40 mm with respect to their resistance to bending. The results of the investigations are presented in the table below:

| | | Indicators | |
|---|---|---|---|
| No. | Dimensions of reinforcement | kgf | MPa |
| 1 | Spiral 7.8 × 3 (mm) | 3900 | 1.9 |
| | | 3400 | 0.95 |
| 2 | Spiral 7.0 × 3 (mm) | 3200 | 0.9 |
| | | 3200 | 0.9 |
| 3 | Rebar Ø 8 (mm) | 4400 | 1.23 |
| | ГОСТ P 52544-2006 | 4200 | 1.18 |

ГОСТ P 52544-2006 is a set of specifications of weldable deformed reinforcing rolled products of classes A500C and B500C for reinforcement of concrete constructions. These specifications can be obtained on the following website: http://www.gosthelp.ru/gost/gost1878.html.

As can be seen from the table, a spiral reinforcement rod with dimensions of 7.8×3 mm may has a comparable strength to a rebar with a cross section diameter (Ø) of 8 mm. The slight difference in strength of these two reinforcements is due to the difference in the size of the diameter of the rebar and the diameter of the cylinder into which the spiral is inscribed.

Thus, to achieve the same strength as the rebar with diameter of 8 mm (a cross-section of which is inscribed in a circle Ø 9.3 mm), a monofilar spiral reinforcement with cross-section section of 9.3×3.2 may be used. Such a spiral reinforcement may be manufacture from a wire rod of 6.5 mm in diameter using, for example, methods described herein below.

Notably, the spiral reinforcement of such a design uses substantial less metal or steel while providing the same strength in comparison to the rebar-type reinforcement.

It should be also noted that upon destruction of reinforced concrete in test No. 3, the concrete split from the rebar-type reinforcement in large pieces, while in tests Nos. 1 and 2 the concrete remained hanging from the spiral reinforcement. This indicates that in the event of failure of building elements, such as during an earthquake, the use of the spiral reinforcement instead of rebars reduces the risk of death or injury of people from collapsing pieces of concrete.

Figure 2:
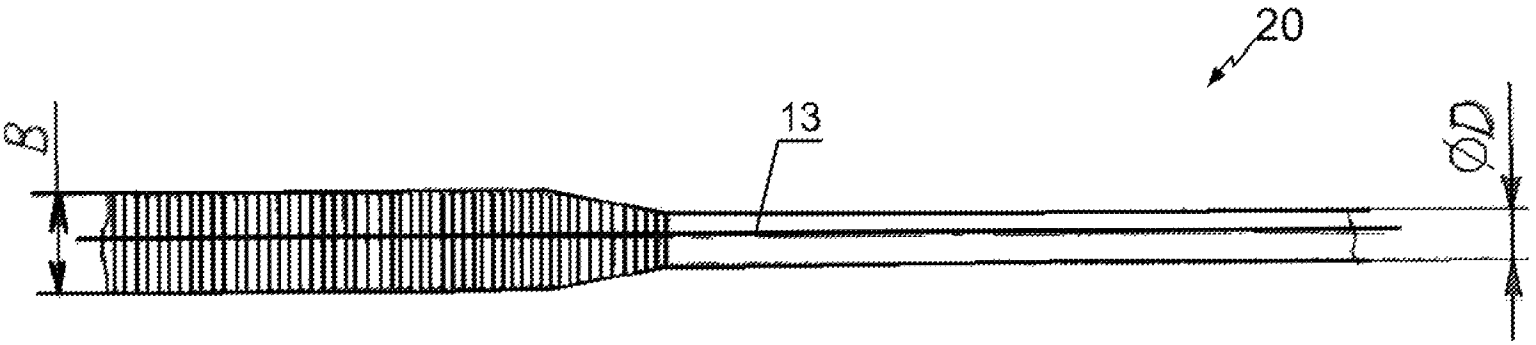
FIGS. 2 and 3 illustrate a process of manufacturing the reinforcement structure from a wire rod in accordance with aspects of the present invention.
Figure 3:
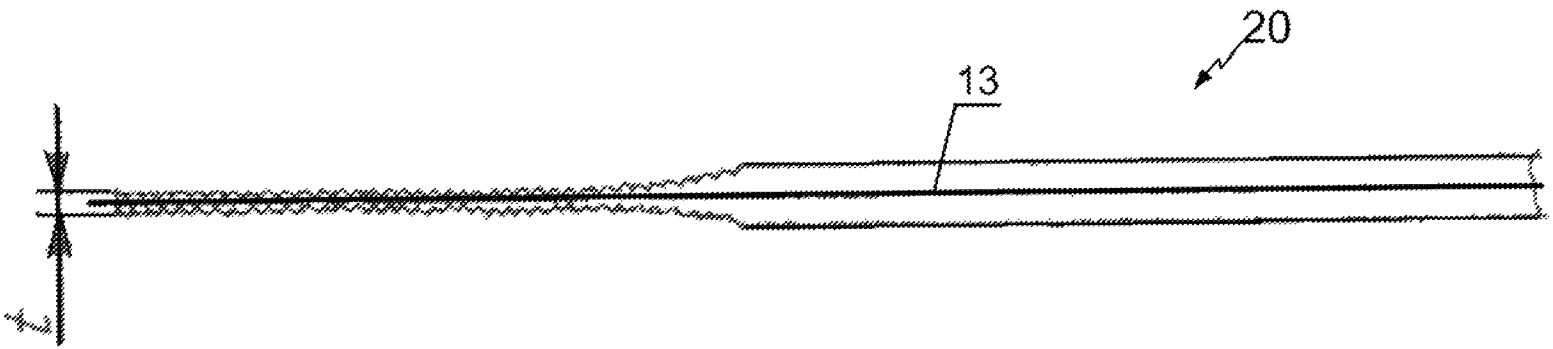

In one example aspect, a monofilar spiral reinforcement structure of FIG. 1 may be manufactured from a wire rod having diameter D as shown in FIGS. 2 and 3. Particularly, a metal or steel wire rod 20 may be flattened, by heating or without, using longitudinal rolling through ribbed rollers, until a cross section of t×B is obtained, where t is the thickness of the resulting strip 11 and B is the width (or diameter) of the strip 11. The flat metal strip 11 may then be twisted into a spiral using known electromechanical or manual twisting devices. In one aspect, the pitch (T) of the spiral of strip 11 may be regular or irregular and may vary (or be constant) between about 1.0 and 10.0 times of the diameter (B). In another aspect, the ratio of the thickness (t) to the diameter (B) of the strip 11 may be in the range of about 1:4 to 1:10.

In another aspect, a monofilar spiral reinforcement structure of FIG. 1 may be manufactured from a rolled flat metal (or steel) strip of specified width (B). Specifically, the strip may be first passed through ribbed rollers, which corrugate ribs on the surfaces of the strip. The edges of the strip may then be rounded by filing or sanding methods. And, lastly, the ribbed strip may be twisted into a spiral of specified pitch as described in detail above.

In another aspect, the speed of rotation of the rollers in either of the manufacturing methods may be constant or varied), and the pitch of the spiral may be varied by continuous regulating of the speed of rotation of the twisting device.

In yet another aspect, a monofilar or multifilar metal spiral reinforcement structure may be manufactured in a single operation using, for example, a helical transverse rolling of one or more cylindrical blanks, such as wire rods. In this case, the steps of flattening of the blank(s) and twisting thereof into spiral(s) may be performed substantially simultaneously. When a short blank is used, it may be passed through one or multiple sets of power-driven rollers having ribbed surfaces. When a long blank is used, it may be manually force-fed through non-motorized rollers. In either case, the rollers may be placed at an angle to the longitudinal axis of the blank. The angle of inclination of the rollers dictates the pitch of the spiral. When passing through the rollers, the blank is rotated and rolled into a spiral.

Figure 4:
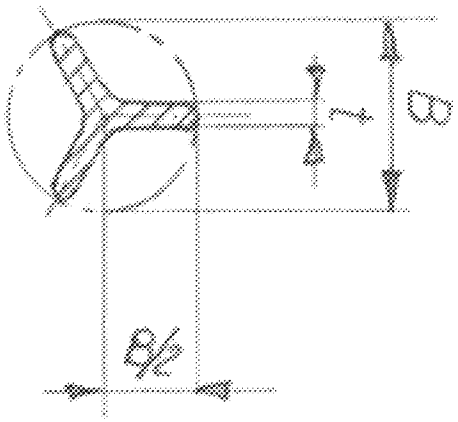
FIG. 4 illustrates a cross-sectional view of a multi-flanged spiral rode in accordance with one aspect of the present invention.
Figure 5:
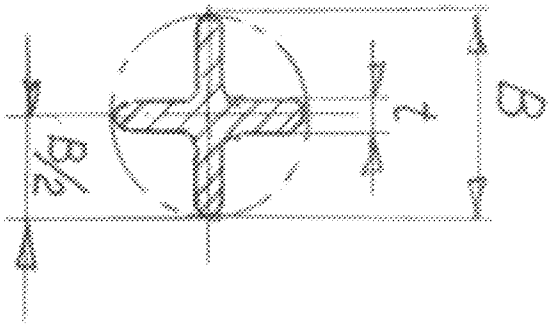
FIG. 5 illustrates a cross-sectional view of a multi-flanged spiral rode in accordance with another aspect of the present invention.

In yet another aspect, a multi-flanged spiral reinforcement structure may be manufactured by extruding from a sheet metal a contour in a shape of a strip or star with multiple flanged, each flanged comprising a flat strip. The number of flanged of the star correspond to the desired number of spirals of the multi-flanged reinforcement structure. The metal contour may then be passed through a rotating calibrator which flattens the flanges to the desired thickness and twists them into the spirals. Concurrently with twisting, the rollers of the calibrator may corrugate ribs of the desired height on one or more of the flattened flanges. FIG. 4 shows a cross-sectional view of an exemplary multi-flanged spiral rode having three flanges. FIG. 4 shows a cross-sectional view of an exemplary multi-flanged spiral rode having three flanges that spiral longitudinally along a length of the rod. FIG. 5 shows a cross-sectional view of an exemplary multi-flanged spiral rode having three flanges that spiral longitudinally along a length of the rod.

In various aspects, the process of manufacturing the spiral reinforcement structure described herein can be performed using known electro-mechanical rolling and twisting devices operated under the control of a computer programmed with specific program instructions. The program may specify, for example, the thickness of the flat trip, the number of spirals, and the pitch of the spirals, as well as other relevant configuration parameters.

In the interest of clarity, not all of the routine features of the aspects are disclosed herein. It will be appreciated that in the development of any actual implementation of the invention, numerous implementation-specific decisions must be made in order to achieve the developer's specific goals, and that these specific goals will vary for different implementations and different developers. It will be appreciated that such a development effort might be complex and time-consuming, but would nevertheless be a routine undertaking of engineering for those of ordinary skill in the art having the benefit of this disclosure.

Furthermore, it is to be understood that the phraseology or terminology used herein is for the purpose of description and not of restriction, such that the terminology or phraseology of the present specification is to be interpreted by the skilled in the art in light of the teachings and guidance presented herein, in combination with the knowledge of the skilled in the relevant art(s). Moreover, it is not intended for any term in the specification or claims to be ascribed an uncommon or special meaning unless explicitly set forth as such.

The various aspects disclosed herein encompass present and future known equivalents to the known components referred to herein by way of illustration. Moreover, while aspects and applications have been shown and described, it would be apparent to those skilled in the art having the benefit of this disclosure that many more modifications than mentioned above are possible without departing from the inventive concepts disclosed herein.

The invention claimed is:

1. A reinforcement for reinforced concrete, comprising a multi-flanged uniform solid metal spiral rod having a star-shaped cross-section and having three or more flanges that spiral longitudinally along a length of the rod, wherein the spiral has a pitch between 1.0 and 10.0 times a diameter of a cylinder into which the spiral rod is inscribed;

wherein a ratio of thickness of one of the three or more flanges to the diameter of the cylinder is in a range of 1:4 to 1:10; and wherein at least one surface of at least one flange of the rod has a plurality of ribs having a height in a range of 0.05% to 0.30% of the thickness of the flange.

2. The reinforcement of claim 1, wherein edges of the three or more flanges are rounded.

3. The reinforcement of claim 1, wherein the spiral has a regular or an irregular pitch.

4. The reinforcement of claim 1, wherein the plurality of ribs include one or more of straight, reticular or pointed ribs.

5. The reinforcement of claim 1, wherein the metal is steel.

* * * * *